US005257877A

United States Patent [19]

Zelinka et al.

[11] Patent Number: 5,257,877

[45] Date of Patent: * Nov. 2, 1993

[54] LIFTING DEVICE

[75] Inventors: Robert F. Zelinka; John W. Redding, both of Roselle, Ill.

[73] Assignee: Perkins Manufacturing Company, Chicago, Ill.

[ * ] Notice: The portion of the term of this patent subsequent to Dec. 3, 2008 has been disclaimed.

[21] Appl. No.: 750,477

[22] Filed: Aug. 27, 1991

Related U.S. Application Data

[63] Continuation of Ser. No. 439,858, Nov. 21, 1989, Pat. No. 5,069,593, which is a continuation of Ser. No. 126,593, Nov. 30, 1987, Pat. No. 4,911,600, which is a continuation of Ser. No. 862,015, May 12, 1986, Pat. No. 4,741,658, which is a continuation of Ser. No. 572,389, Jan. 20, 1984, abandoned.

[51] Int. Cl.[5] ..... B65F 3/02

[52] U.S. Cl. ..... 414/408; 414/406; 414/421

[58] Field of Search ..... 414/406, 407, 411, 404, 414/408, 405, 419, 420, 421, 422, 423, 424, 425, 539, 540, 541, 546, 555, 558, 786

[56] References Cited

U.S. PATENT DOCUMENTS

| | | | |
|---|---|---|---|
| 3,032,216 | 5/1962 | McCarthy . | |
| 3,327,876 | 6/1967 | Kolling . | |
| 3,732,997 | 5/1973 | Reavis . | |
| 3,738,516 | 6/1973 | Wells . | |
| 3,747,785 | 7/1973 | Dahlin . | |
| 3,804.277 | 4/1974 | Brown . | |
| 3,823,973 | 7/1974 | Ramer | 294/73 |
| 3,884.376 | 5/1975 | Rivers . | |
| 3,894,642 | 7/1975 | Shive . | |
| 3,931,901 | 1/1976 | Jones . | |
| 4,042,137 | 8/1977 | Hughes . | |
| 4,365,922 | 12/1982 | Borders | 414/406 |
| 4,422,814 | 12/1983 | Borders | 414/303 |
| 4,479,751 | 10/1984 | Wyman | 414/406 |
| 4,673,327 | 6/1987 | Knapp | 414/408 |
| 4,741,658 | 5/1988 | Zelinka | 414/406 |
| 4,773,812 | 9/1988 | Bayne | 414/408 |
| 4,911,600 | 3/1990 | Zelinka | 414/408 |
| 5,024,573 | 6/1991 | Redding | 414/408 |
| 5,069,593 | 12/1991 | Zelinka et al. | 414/408 |

FOREIGN PATENT DOCUMENTS

| | | |
|---|---|---|
| 243183 | 10/1965 | Austria . |
| 622499 | 5/1961 | Canada . |
| 844262 | 8/1949 | Fed. Rep. of Germany . |
| 811456 | 8/1951 | Fed. Rep. of Germany . |
| 1236403 | 3/1967 | Fed. Rep. of Germany . |
| 2146653 | 3/1973 | Fed. Rep. of Germany . |
| 3024081 | 1/1981 | Fed. Rep. of Germany . |
| 2479783 | 10/1981 | Fed. Rep. of Germany . |

(List continued on next page.)

OTHER PUBLICATIONS

Lifting Mechanism for a Sanitation Vehicle, U.S. patent application Ser. No. 378,823, filed May 12, 1982, now abandoned (bearing production Nos. B984–1005), with photographs (dated Dec., 1981) (bearing production Nos. B1082–1097), photographs of a present version of the above cited reference (bearing production Nos. B1098–1110), and other related documents (bearing production Nos. 935–947, 949–983, 1006–1081 and 1111–1125).

(List continued on next page.)

*Primary Examiner*—Frank E. Werner

*Attorney, Agent, or Firm*—Cook, Egan, McFarron & Manzo, Ltd.

[57] ABSTRACT

A lifter for emptying a container into a cavity of a vehicle. The lifter has a first plate pivotally connected to the vehicle, and a second plate extending at an angle from the first plate. The lifter has a third plate slidably mounted on the second plate, with the third plate having a pair of hooks to grasp bars on the container. The lifter moves between a first lower position beneath the truck to a second upper position with the container located above the cavity to empty the container into the cavity.

19 Claims, 3 Drawing Sheets

FOREIGN PATENT DOCUMENTS

| | | |
|---|---|---|
| 2272002 | 12/1975 | France . |
| 7916588 | 6/1979 | France . |
| 2500425 | 8/1982 | France . |
| 83/03242 | 9/1983 | PCT Int'l Appl. . |
| 358747 | 9/1957 | Switzerland . |
| 453203 | 3/1968 | Switzerland . |
| 291709 | 6/1928 | United Kingdom . |
| 2078196 | 1/1982 | United Kingdom . |

OTHER PUBLICATIONS

Related U.S. patent application Ser. No. 07/439,858, entitled Lifting Device, filed Nov. 21, 1989, pending (no copy attached).

Refuse Removal Systems, Inc. "Waste Wheeler", *Waste Age,* 1982 (with photographs of the device bearing production Nos. B913–922).

Rubbermaid "Mobile Toter".

McKagen, *World Wastes,* "Supercan! Can . . . And Does", Jun. 1983, pp. 24–26.

*Waste Age,* Mar. 1982, pp. 31–33.

FIG. 1
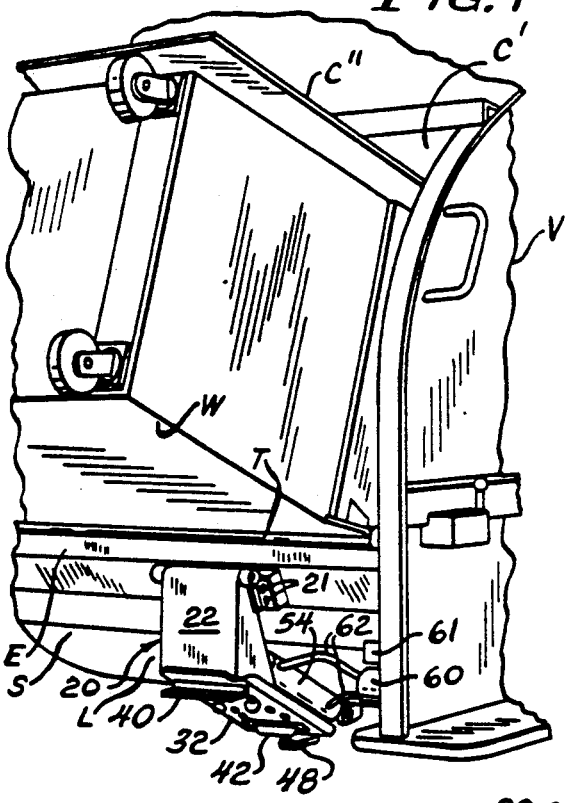
FIG. 2
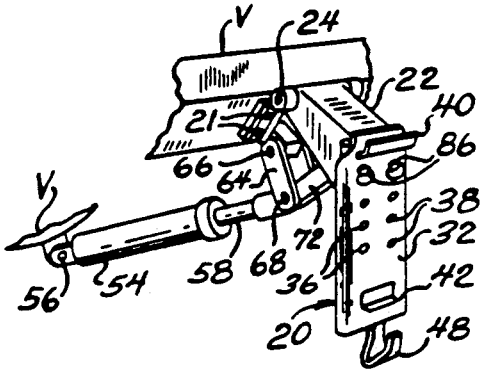
FIG. 5
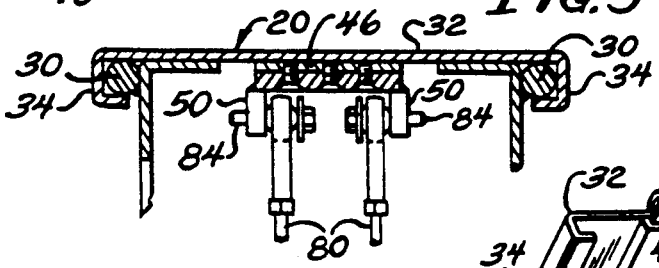
FIG. 3
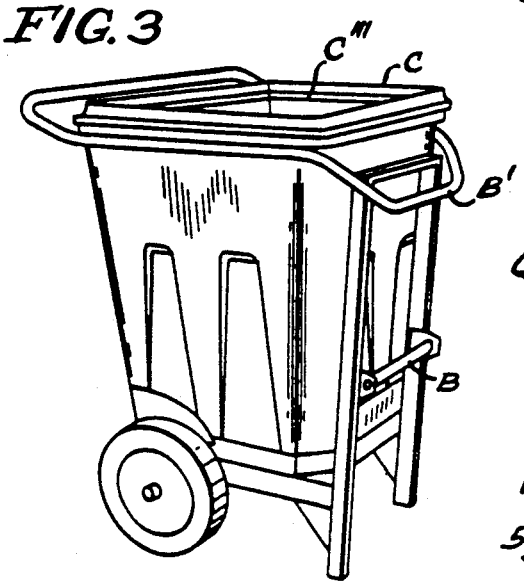
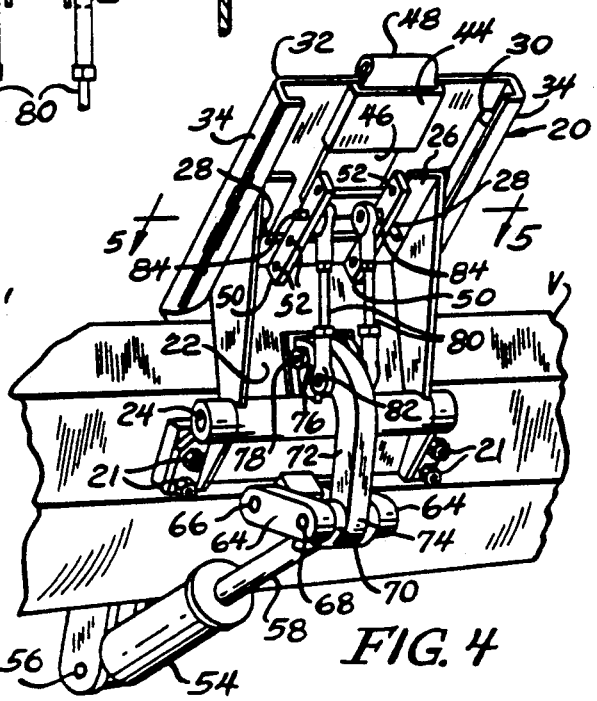
FIG. 4

LIFTING DEVICE

This is a continuation of application Ser. No. 439,858, filed Nov. 21, 1989 (now U.S. Pat. No. 5,069,593), which is a continuation of application Ser. No. 126,593, filed Nov. 30, 1987 (now U.S. Pat. No. 4,911,600), which is a continuation of application Ser. No. 862,015, filed May 12, 1986 (now U.S. Pat. No. 4,741,658), which is a continuation of application Ser. No. 572,389, filed Jan. 20, 1984 (now abandoned).

BACKGROUND OF THE INVENTION

The present invention relates to lifting devices.

Before the present invention, lifting devices have been proposed for dumping containers into the cavity of a vehicle, such as refuse trucks. An initial problem with prior devices is that they are large and cumbersome. Also, the prior lifters have prevented access to the vehicle for pivot dumping large rear loading containers. One prior device folds to a side of the vehicle to permit access to the vehicle, but the device obstructs traffic in this position.

SUMMARY OF THE INVENTION

A principal feature of the present invention is the provision of an improved lifter for emptying a container into a cavity of a vehicle which does not interfere with access for pivot dumping large rear loading containers.

In a preferred embodiment, the lifter of the present invention comprises a first plate pivotally mounted to the vehicle, and a second plate extending at an angle from the first plate. The lifter has a third plate slidably mounted on the second plate, with the third plate having a pair of spaced hooks. The lifter has means for driving the plates and hooks between a first lower, retracted position to a a series of second upper position.

A feature of the present invention is that in the first position the lifter is located beneath the vehicle.

Thus, a feature of the present invention is that when the lifter is at the first position access is permitted to the vehicle in order to dump a large rear loading container into the vehicle.

Another feature of the invention is that the hooks grasp bars on the container as the lifter moves between the first and second positions.

Yet another feature of the invention is that the lifter places the container above the cavity at the second position in order to empty the container into the vehicle cavity.

A further feature of the invention is that one of the hooks clamp on the container bar to prevent the container from falling into the cavity while it is being emptied.

Still another feature of the invention is that the hooks are adjustable in height on the lifter.

Thus, a further feature of the invention is that the lifter may be adjusted to accommodate changes in the truck as refuse is dumped into the vehicle or differences in height when the vehicle is located on a hill.

Further features will become more fully apparent in the following description of the embodiments of this invention and from the appended claims.

DESCRIPTION OF THE DRAWINGS

In the drawings:

FIG. 1 is a fragmentary perspective view illustrating a lifter of the present invention in a first lower position;

FIG. 2 is a fragmentary perspective view of the lifter of FIG. 1;

FIG. 3 is a perspective view of a container which is emptied into a vehicle by the lifter of the present invention;

FIG. 4 is a fragmentary perspective view of the lifter in a second upper position;

FIG. 5 is a fragmentary sectional view taken substantially as indicated along the line 5—5 of FIG. 4;

DESCRIPTION OF THE PREFERRED EMBODIMENTS

Figure 6:
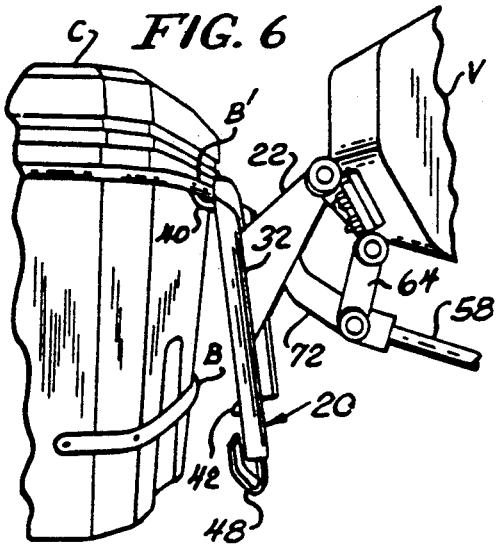
FIGS. 6–8 are fragmentary perspective views illustrating the lifter in operation to empty the container into the vehicles.

Referring now to FIG. 1, there is shown a lifter 20 of the present invention which is mounted by bolts 21 on the rear of a vehicle V such as a refuse truck. Although the lifter 20 is shown mounted on the right rear side of the vehicle V, it will be understood that another lifter of the same type may be mounted on the left side of the vehicle V. The vehicle V has a hopper container sill S defining a lower portion of a rearwardly facing opening to the cavity C' to receive and retain refuse. The sill S has a lower portion L slanting upwardly and rearwardly to a leading sill edge E over which the refuse is dumped. As shown FIG. 1 the lifter 20 is located at a first, or lower, position beneath the sill S of the vehicle V, with the lifter 20 being mounted by the bolts 21 adjacent but beneath the edge E of the sill S to permit horizontal access to the edge E from the edge E to the ground. The lifter 20 of the present invention is utilized to empty a first type of containers C of FIG. 3 into the cavity C' of the vehicle V of a type which are too short to matingly engage the sill and thus must be lifted above the sill. With reference to FIG. 1, with the lifter 20 in its lower or retrarted position the lifter 20 is located sufficiently beneath the sill s, such that, access at a level vertically beneath the edge E to the ground is permitted to the sill s at the rear of the vehicle in order to empty large rear loading containers C" of the type which are tall enough to be unloaded by tilting without lifting, as shown in FIG. 1, in a tilted position. Before and after dumping of the container C", the front wall W of the container C" extends substantially vertically from the sill edge E toward the ground. The container C" has an elongated trunnion bar T at an uppermost portion of the container C" which is located adjacent to the sill edge when the container C" is dumped, as shown in FIG. 1. Thus, in accordance with the present invention, the lifter 20 lifts and tilts small containers without interfering with the emptying of large containers into the vehicle V.

With reference to FIG. 3, the container C with which the lifter 20 operates has a lower front bar B and an upper front bar B'. The container C has a chamber C''' with an open top into which refuse is dumped by the user for storage until the container C is emptied into the vehicle V of FIG. 1.

With reference to FIGS. 1, 2, 4, and 5, the lifter 20 has a first plate 22 having an inner end pivotally connected at 24 to the rear of the vehicle V adjacent the cavity C'. The lifter 20 has a second plate 26 extending at an angle from an outer end of the first plate 22. The second plate 26 has a pair of spaced apertures 28 extending therethrough for a purpose which will be described below. Also, the second plate 26 has a pair of spaced rods 30 at opposed sides of the second plate 26 and extending along the second plate 26.

The lifter 20 has a third plate 32 having a pair of flanges 34 at opposed sides of the third plate 32 and partially extending around the rods 30 of the second plate 26, such that the third plate 32 is slidably mounted on the second plate 26. The third plate 32 has a first set of openings 36 aligned along the third plate 32, and a second set of openings 38 aligned along the length of the third plate 32, such that the openings 36 and 38 register with the apertures 28 of the second plate 26. The third plate 32 has an upper outwardly directed hook or hook member 40 adjacent an inner end of the third plate 32. The third plate 32 also has an outwardly directed flange 42 adjacent an outer end of the third plate 32.

The third plate 32 has an inner tunnel 44 adjacent an outer end of the third plate 32. The third plate 32 has hook means comprising a tongue 46 slidably received in the tunnel 44, and a hook or hook member 48 extending from an outer end of the tongue 46 and being directed toward the flange 42. The lifter 20 has a pair of elongated opposed flanges 50 connected to an inner end of the tongue 46, with the flanges 50 having a plurality of apertures 52 spaced along their length.

The lifter 20 has a hydraulic cylinder 54 having one end pivotally connected at 56 beneath the vehicle. The cylinder 54 has a piston 58 which may move in and out of the cylinder 54. The piston 58 of the cylinder 54 is driven by a pump 60 through conduits 62, with the pump 60 being driven by a motor 61 which is powered by the electrical system of the vehicle V.

The lifter 20 has a pair of link arms 64 having an inner end pivotally connected at 66 to the vehicle V, and outer ends pivotally connected at 68 to an outer end 70 of the piston 58. The lifter 20 has an arcuate arm 72 having one end 74 pivotally connected to the outer end 70 of the piston 58 and outer ends of the link arms 64 at connection 68, and the other end 76 pivotally connected at 78 to an inner end of the first plate 22.

The lifter 20 has a pair of rods 80 having one end pivotally connected at 82 to a central portion of the arcuate arm 72 intermediate the pivotal connections 68 and 78. The other ends of the rods 80 have pins 84 which are pivotally received in selected apertures 52 of the flanges 50.

Figure 7:
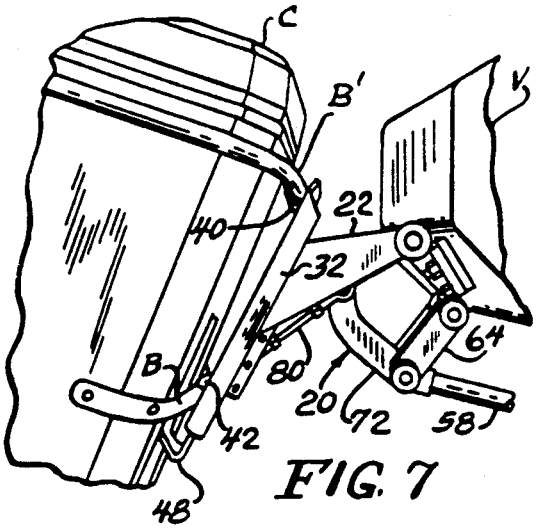
Figure 8:
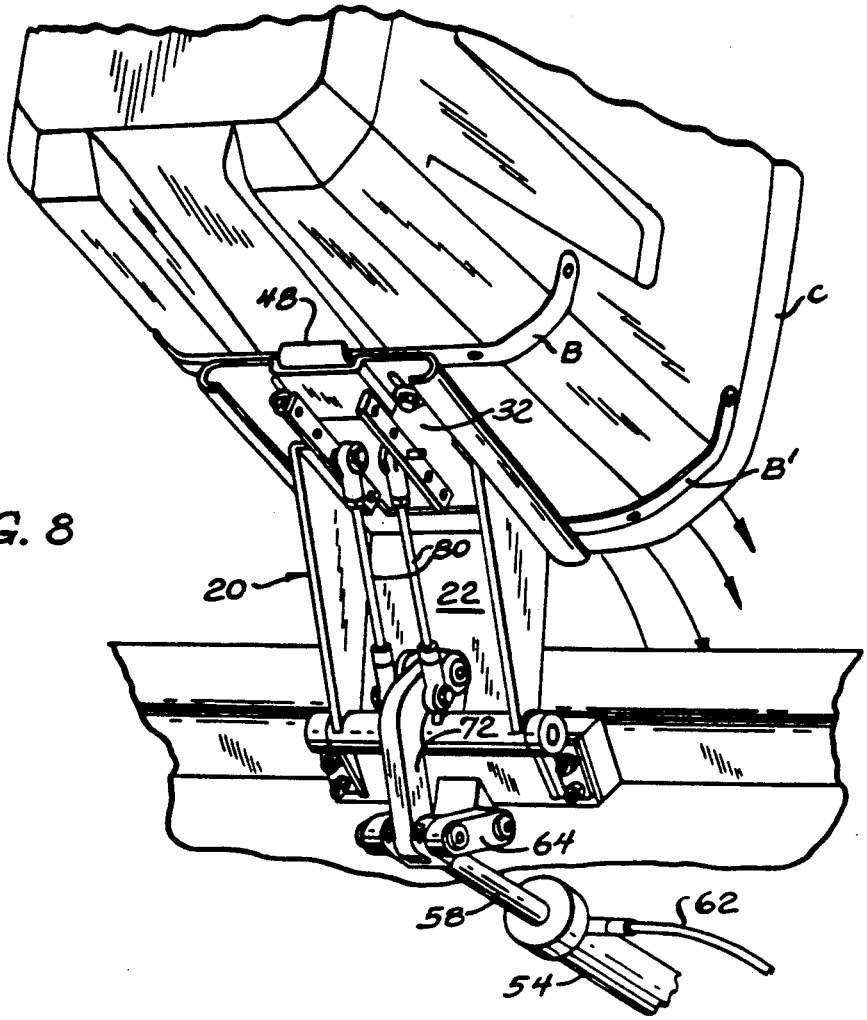

In operation, the lifter 20 is initially located in a first lower position beneath the vehicle V, as shown in FIG. 1. In this configuration, the hook 48 is spaced from the flange 42. Prior to use of the lifter 20, the container C of FIG. 3 is moved to a position behind the lifter 20. With reference to FIG. 6, as the cylinder 54 is operated by the pump 60 and motor 61 to drive the piston 58 out of the cylinder 54, the lifter 20 moves from beneath the truck and the hook 40 initially catches the uppe bar B' of the container C. With reference to FIG. 7, as the piston 58 is driven further from the cylinder 54, the lower bar B of the container C is received between the hook 48 and the flange 42. Next, as the cylinder 54 further drives the lifter 20 in an upward direction, the hook 48 moves toward the flange 42 in order to clamp the lower bar B of container C between the hook 48 and flange 42 and prevent the container C from falling into the cavity C' of the vehicle V. Finally, with reference to FIG. 8, the lifter 20 is driven to a second upper position with the container C located above the cavity C' of the vehicle V in an upside down orientation in order to empty the container C into the cavity C' of the vehicle V. After the container C has been emptied into the vehicle V, the lifter 20 is driven from the second upper position to the first lower position while the hook 48 moves away from the flange 42 in order to release the lower bar B of the container C. In this manner, the lifter 20 of the present invention may be readily and simply used in order to empty the container C into the cavity C' of the vehicle V.

Figure 9:
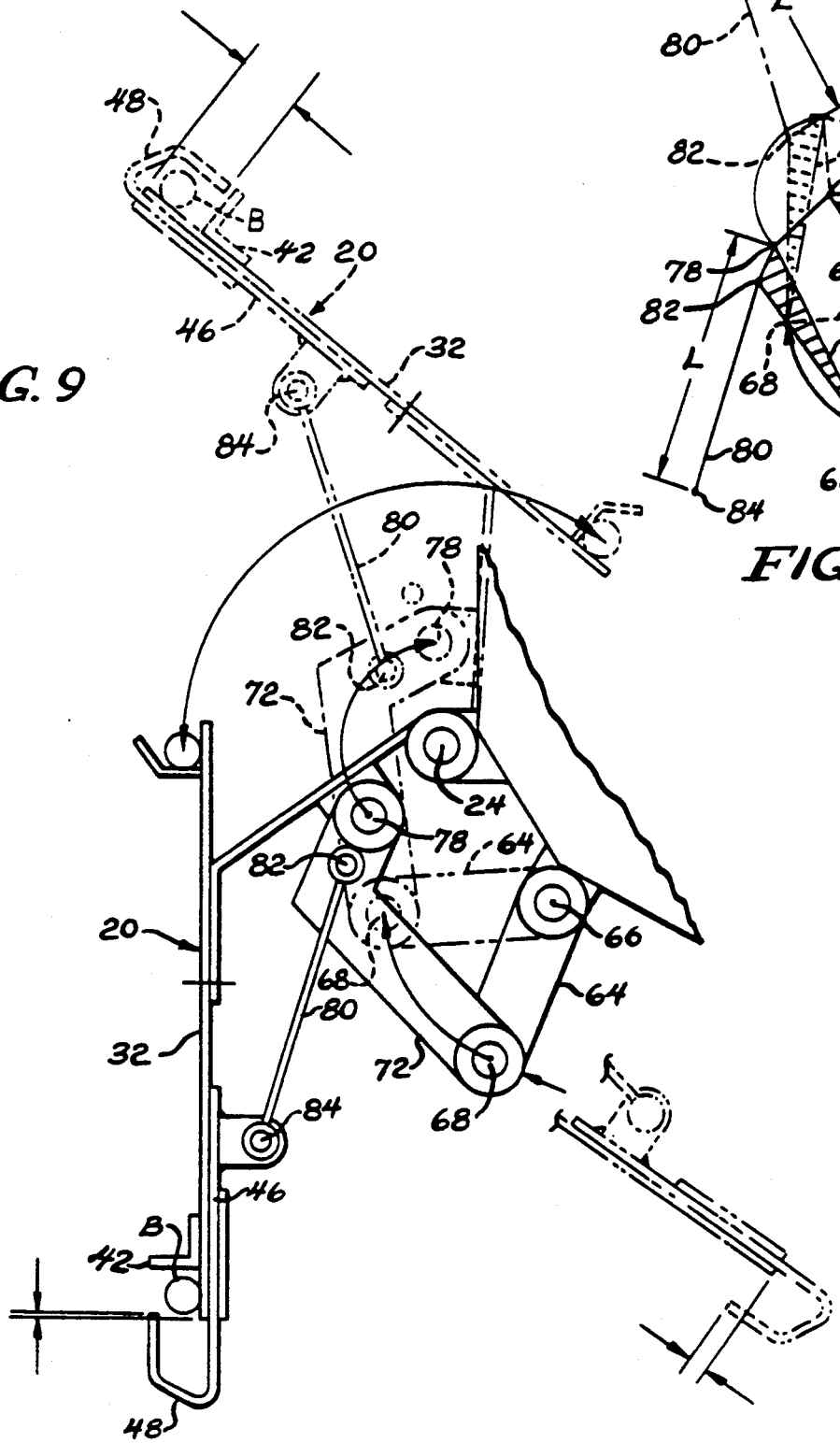
FIGS. 9 and 10 are diagrammatic views illustrating operation of the lifter of the present invention.
Figure 10:
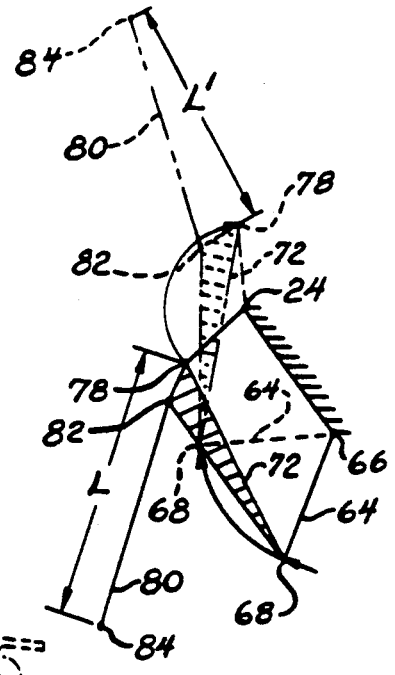

The manner in which the hook 48 is moved toward and away from the flange 42 during movement of the lifter 20 will be discussed in connection with FIGS. 9 and 10 where the lifter 20 is shown in solid lines in a lower position and in dotted lines in an upper position. As shown, the pivotal connections 78, 82, and 84 are located on nearly a straight line at the lower position of the lifter 20 and define a distance L between the connections 78 and 84. In the upper position of the lifter 20, the connections 78, 82, and 84 form a triangle to define the distance L'. Therefore, it will be apparent that the distance L' between the connections 78 and 84 is less in the upper position of the lifter 20 than the distance L in the lower position of the lifter 20. Accordingly, the rods 80 pull on the tongue 46 as the distance between connections 78 and 84 lessens while the lifter 20 rises, and the tongue 46 moves the hook 48 over the bar B as the lifter 20 rises and the distance L shortens. In this manner, the hook 48 is clamped on the bar B as the lifter 20 moves toward its upper position. In a preferred form, the hook 48 clamps on the bar B when the lifter 20 is approximately in a horizontal position. In reverse, as the lifter 20 lowers from its upper position the distance L' increases and the rods 80 move the tongue 46 and hook 48 toward an outer position in order to release the bar B. In this manner, the lifter 20 of the present invention clamps the bar B of the container C as the lifter rises to its second upper position in order to prevent the container from falling into the cavity C' of the vehicle as the container C is emptied.

As refuse is placed in the cavity C' of the vehicle V, the vehicle V settles and the height of the hooks 48 and 40 may change with respect to the bars of the container C. Also, when the vehicle is placed on a hill, the height of the hooks 48 and 40 may change relative to the bars of the container C. In accordance with the present invention, the height of the hooks 48 and 40 may be adjusted relative to the bars B and B' of the container C to accommodate these changes. The openings 36 and 38 of the third plate 32 may be selectively positioned in register with the apertures 28 of the second plate 26 as the third plate 32 is slid relative to the second plate 26. Once the selected openings 36 and 38 are in register with the apertures 28, a pair of pins 86 are placed through the openings 36 and 38 and the apertures 28 in order to retain the third plate 32 in place relative to the second plate 26. Prior to adjustment of the third plate 32, the pins 84 of the rods 80 are removed from the apertures 52 of the flanges 50, and the pins 84 are then inserted into different apertures 52 of the flanges 50 depending upon the location of the third plate 32. Of course, the position of the hooks 48 and 40 are fixed with respect to the third plate 32, and thus the height of the hooks 48 and 40 are adjusted relative to the container C through adjustment of the position of the third plate 32 in the manner described.

Thus, in accordance with the present invention, the lifter 20 may be positioned beneath the vehicle V to permit access to the vehicle V and empty large rear loading containers into the vehicle V. Also, the lifter 20 grasps a container C during movement to a second upper position in order to empty the container C into the vehicle V. In accordance with the invention, the lifter 20 has a hook 48 which clamps on a bar B of the container C during upward movement of the lifter 20, in order to prevent the container C from falling into the cavity C' of the vehicle V as the container C is being emptied, and the hook 48 automatically releases the bar B of the container C as the lifter 20 moves from its upper to lower position. Also, the height of hooks 48 and 40 of the lifter 20 may be adjusted relative to the bars B and B' of the container C such that the hooks 48 and 40 appropriately grasp the bars B and B' on the container C during operation of the lifter 20.

The foregoing detailed description is given for clearness of understanding only, and no unnecessary limitations should be understood therefrom, as modifications will be obvious to those skilled in the art.

We claim:

1. A receptacle dumping assembly for lifting and dumping refuse receptacles, which assembly is attachable to rear-loading refuse collection vehicles, including vehicles which are adapted for dumping substantially larger rear-loading type refuse containers having a substantially vertical front wall, having a rearwardly opening refuse receiving cavity including side walls and a floor extending upwardly and rearwardly toward a rearward edge portion of said vehicle over which refuse is dumped into the cavity, the rearward edge portion including a top surface and a rear surface, said receptacle dumping assembly comprising:

a receptacle lifter which includes means for capturing and releasing a refuse receptacle;

means for mounting said receptacle lifter to the rear of the refuse collection vehicle generally adjacent said rearward edge portion, said lifter being movable between a first lifter position and a second lifter position;

hydraulically actuated means for moving said receptacle lifter between said first and second positions;

said first lifter position being located sufficiently below an imaginary horizontal plane along the top surface of said rearward edge portion and sufficiently on the cavity side of an imaginary vertical plane along the rear surface of said rearward edge portion such that access to said rearward edge portion from opposite the cavity side of said vertical plane is substantially unobstructed by said lifter to permit other loading of refuse into the cavity, such as by tilting substantially larger rear-loading type containers having a substantially vertical front wall over the rearward edge portion;

said second lifter position being located above said imaginary horizontal plane for dumping refuse into the cavity from a refuse receptacle;

said means for moving said lifter being adapted to move only said lifter and to allow said lifter to remain in said first position when access to said rearward edge portion is desired to permit other loading of refuse into the cavity, such as the tilting of substantially larger containers over the rearward edge portion; and means cooperatively associated with said lifter for moving said capture and release means between release and capture positions as said lifter moves between said first and second lifter positions.

2. A receptacle dumping assembly in accordance with claim 1 wherein the rearward edge portion comprises a container sill.

3. A receptacle dumping assembly in accordance with claim 1 wherein said lifter is adapted to be located substantially beneath the vehicle when in said first position.

4. A receptacle dumping assembly in accordance with claim 1 wherein said lifter is adapted to move through a path wherein said lifter is closest to ground level at a position intermediate said first and second positions.

5. A receptacle dumping assembly in accordance with claim 1 wherein said lifter includes a rigid member having first and second ends and a plate portion carrying at least a portion of said capture and release means, said rigid member being adapted for pivotal mounting to the vehicle at said first end and fixedly attached at an obtuse angle to said plate portion, and whereby said rigid portion extends substantially vertically and said plate portion extends forwardly under the vehicle when said lifter is in said first position.

6. A receptacle dumping assembly in accordance with claim 1 wherein said means for moving said lifter further comprises an arcuate link having a first end, a second end and an arcuate portion therebetween, said arcuate link being pivotally attached to said lifter at the first end and adapted to be pivotally carried by the vehicle at the second end.

7. A receptacle dumping assembly in accordance with claim 6 further comprising a second link having a first end and a second end, the first end of said second link being attached to said capture and release means and the second end of said second link being attached to said arcuate link at a location spaced substantially between said first end of said arcuate link and said arcuate portion of said arcuate link.

8. A receptacle dumping assembly in accordance with claim 6 further comprising a third link having a first end pivotally attached to said vehicle and a second end pivotally attached to said second end of said arcuate link.

9. A receptacle dumping assembly in accordance with claim 1 wherein said capture and release means includes an upper hook and a lower hook, said upper hook member being fixedly mounted to said lifter for engagement under one portion of the receptacle as the lifter moves from the first lifter position to the second lifter position to lift the receptacle, said lower hook member being slidably movable relative to said upper hook to engage over another portion of the receptacle to retain the receptacle on said lifter.

10. A rear loading refuse collection vehicle, said vehicle comprising:

a rearwardly opening refuse receiving cavity including side walls and a floor extending upwardly and rearwardly toward a rearward edge portion of said vehicle over which refuse is dumped into said cavity, said rearward edge portion having a top surface and rear surface;

a receptacle dumping assembly carried by said vehicle for dumping refuse receptacles, said receptacle dumping assembly including a receptacle lifter and including means for capturing and releasing a refuse receptacle;

means mounting said receptacle lifter generally adjacent said rearward edge portion, said lifter being movable between a first lifter position and a second lifter position;

hydraulically actuated means for moving said receptacle lifter between said first and second lifter positions;

said first lifter position being located sufficiently below an imaginary horizontal plane along the top surface of said rearward edge portion and sufficiently on the cavity side of an imaginary vertical plane along the rear surface of said rearward edge portion so that access to said rearward edge portion from opposite the cavity side of said vertical plane is substantially unobstructed by said receptacle lifter to permit other loading of refuse into said cavity, such as by tilting substantially larger rear-loading type containers having a substantially vertical front wall over said rearward edge portion;

said second lifter position being located above said imaginary horizontal plane for dumping refuse into said cavity from a refuse receptacle;

said means for moving said lifter being adapted to move only said lifter and to allow said lifter to remain in said first position when access to said rearward edge portion is desired to permit other loading of refuse into said cavity, such as the tilting of substantially larger containers over the rearward edge portion; and means cooperatively associated with said lifter for moving said capture and release means between release and capture positions as said lifter moves between said first and second lifter positions.

11. A rear loading refuse collection vehicle in accordance with claim 10 wherein said rearward edge portion comprises a container sill.

12. A rear loading refuse collection vehicle in accordance with claim 10 wherein said lifter is located substantially beneath said vehicle when in said first position.

13. A rear loading refuse collection vehicle in accordance with claim 10 wherein said lifter is adapted to move through a path wherein said lifter is closest to ground level at a position intermediate said first and second positions.

14. A rear loading refuse collection vehicle in accordance with claim 10 wherein said lifter includes a rigid member having first and second ends and a plate portion carrying at least a portion of said capture and release means, said rigid member being adapted for pivotal mounting to the vehicle at said first end and fixedly attached at an obtuse angle to said plate portion, and whereby said rigid portion extends substantially vertically and said plate portion extends forwardly under the vehicle when said lifter is in said first position.

15. A receptacle dumping assembly in accordance with claim 10 wherein said means for moving said lifter further comprises an arcuate link having a first end, a second end and an arucate portion therebetween, said arcuate link being pivotally attached to said lifter at the first end and adapted to be pivotally carried by the vehicle at the second end.

16. A receptacle dumping assembly in accordance with claim 15 further comprising a second link having a first end and a second end, the first end of said second link being attached to said capture and release means and the second end of said second link being attached to said arucate link at a location spaced substantially between said first end of said arcuate link and said arcuate portion of said arcuate link.

17. A receptacle dumping assembly in accordance with claim 15 further comprising a third link having a first end pivotally attached to said vehicle and a second end pivotally attached to said second end of said arcuate link.

18. A rear loading refuse collection vehicle in accordance with claim 10 wherein said vehicle is adapted for receiving refuse from substantially larger rear-loading type refuse containers.

19. A receptacle dumping assembly in accordance with claim 10 wherein said capture and release means includes an upper hook and a lower hook, said upper hook member being fixedly mounted to said lifter for engagement under one portion of the receptacle as the lifter moves from the first lifter position to the second lifter position to lift the receptacle, said lower hook member being slidably movable relative to said upper hook to engage over another portion of the receptacle to retain the receptacle on said lifter.

* * * * *

UNITED STATES PATENT AND TRADEMARK OFFICE

CERTIFICATE OF CORRECTION

PATENT NO. : 5,257,877

DATED : November 2, 1993

INVENTOR(S) : Robert F. Zelinka and John W. Redding

It is certified that error appears in the above-identified patent and that said Letters Patent is hereby corrected as shown below:

On the title page, after item "[73] Assignee:" and within the special "[*] Notice:" statement: change "Dec. 3, 2008" to --May 3, 2005--.

Signed and Sealed this

Nineteenth Day of July, 1994

Bruce Lehman

*Attest:*

BRUCE LEHMAN

*Attesting Officer*

*Commissioner of Patents and Trademarks*